US012203395B2

(12) United States Patent
Lemrani et al.

(10) Patent No.: US 12,203,395 B2
(45) Date of Patent: Jan. 21, 2025

(54) TURBINE CONTROL VALVES DYNAMIC INTERACTION

(71) Applicant: GENERAL ELECTRIC COMPANY, Schenectady, NY (US)

(72) Inventors: Hassan Lemrani, Levallois-Perret (FR); Caroline Jaillot, Levallois-Perret (FR); Nicolas Le Goff, Levallois-Perret (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 426 days.

(21) Appl. No.: 16/312,795

(22) PCT Filed: Jun. 9, 2017

(86) PCT No.: PCT/EP2017/064113
§ 371 (c)(1),
(2) Date: Dec. 21, 2018

(87) PCT Pub. No.: WO2017/220344
PCT Pub. Date: Dec. 28, 2017

(65) Prior Publication Data

US 2021/0293156 A1 Sep. 23, 2021

(30) Foreign Application Priority Data

Jun. 21, 2016 (EP) ..... 16290111

(51) Int. Cl.
*F01K 7/16* (2006.01)
*F01K 7/22* (2006.01)
*F01K 13/02* (2006.01)

(52) U.S. Cl.
CPC ..... *F01K 7/165* (2013.01); *F01K 7/22* (2013.01); *F01K 7/223* (2013.01); *F01K 13/02* (2013.01)

(58) Field of Classification Search
None
See application file for complete search history.

(56) References Cited

U.S. PATENT DOCUMENTS 3,561,216 A * 2/1971 Moore ..... F01K 7/24 700/289
3,614,457 A * 10/1971 Eggenberger ..... F01D 21/02 290/40 R (Continued)

FOREIGN PATENT DOCUMENTS

GB 2 176 248 A 12/1986
JP 856009607 A 1/1981

(Continued)

OTHER PUBLICATIONS

EP Search Report for application No. 16290111.0-1610, dated Dec. 9, 2016.

(Continued)

*Primary Examiner* — Wesley G Harris
(74) *Attorney, Agent, or Firm* — Grogan, Tuccillo & Vanderleeden LLP

(57) ABSTRACT

Method for controlling steam admission into a steam turbine, the turbine comprising a high pressure casing, at least one reduced pressure casing and an admission steam control system, the high pressure casing and at least one reduced pressure casing comprising control valves for steam admission. The admission steam control system manages the following steps: determining a steam flow demand; elaborating a high pressure control valve opening setpoint depending on the determined steam flow demand; imposing the elaborated high pressure control valve opening setpoint to the high pressure control valves; elaborating a reduced pressure control valve opening setpoint depending on the determined steam flow demand through the dynamic interaction between high pressure control valve opening setpoint (Continued)

Figure 1:
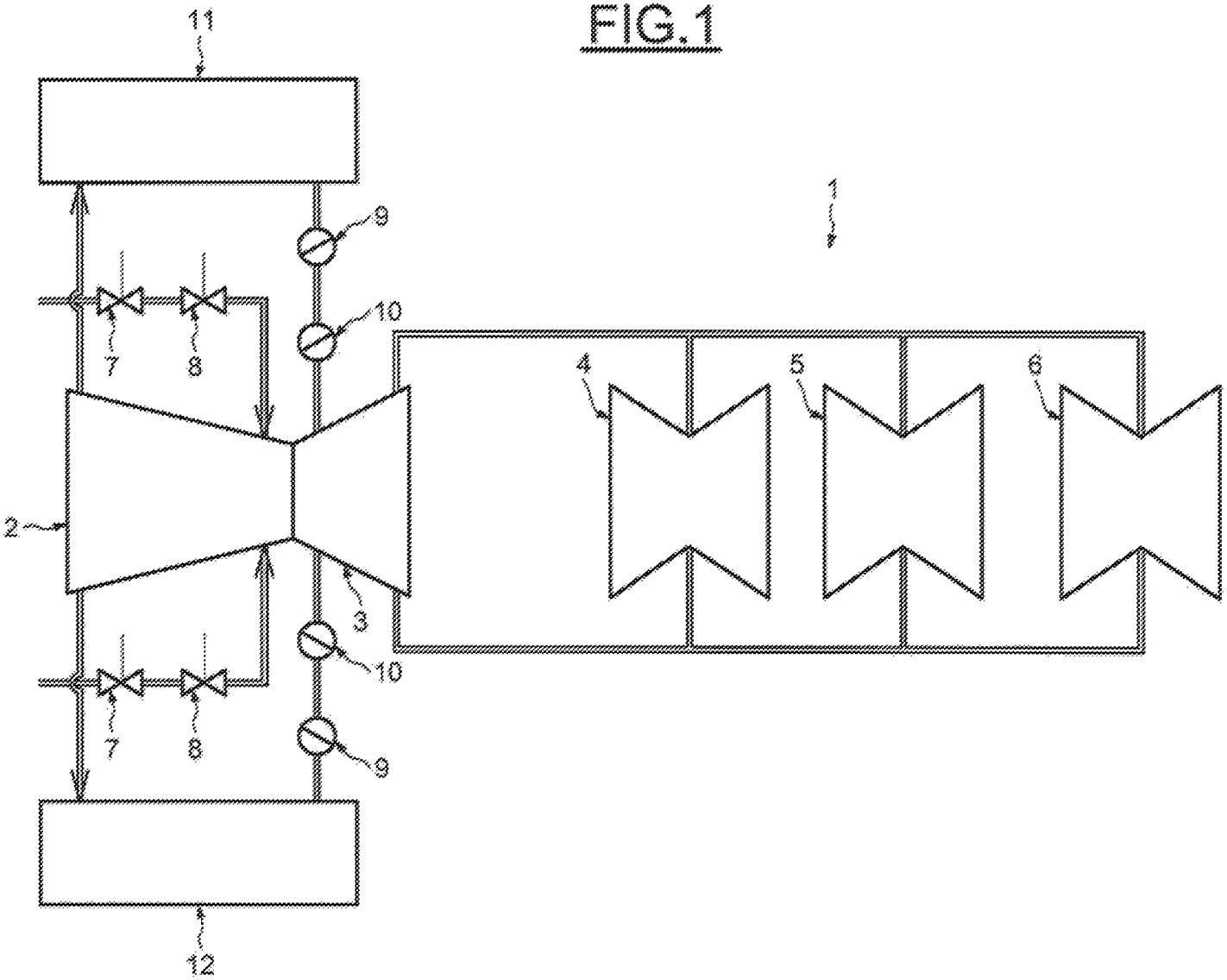

and reduced pressure control valve opening setpoint; and imposing the elaborated reduced pressure control valve opening setpoint to the reduced pressure control valves.

2 Claims, 2 Drawing Sheets

(56) References Cited

U.S. PATENT DOCUMENTS

| | | | | | |
|---|---|---|---|---|---|
| 3,643,437 | A * | 2/1972 | Birnbaum | F01K 7/24 | 290/40 R |
| 3,848,138 | A * | 11/1974 | Park | F01D 21/02 | 290/40 R |
| 4,007,596 | A | 2/1977 | Braytenbah et al. | | |
| 4,095,119 | A * | 6/1978 | Nangle | F01D 21/02 | 290/40 R |
| 4,253,308 | A | 3/1981 | Eggenberger et al. | | |
| 4,306,417 | A * | 12/1981 | Binstock | F22B 35/008 | 60/676 |
| 4,316,362 | A * | 2/1982 | Ninomiya | F01K 7/22 | 60/656 |
| 4,577,281 | A * | 3/1986 | Bukowski | F01D 17/24 | 700/289 |
| 2014/0102097 | A1* | 4/2014 | Cornell | F01K 7/04 | 60/645 |
| 2014/0165565 | A1 | 6/2014 | Shindo | | |

FOREIGN PATENT DOCUMENTS

| | | | |
|---|---|---|---|
| JP | S58065910 | A | 4/1983 |
| JP | S61055303 | A | 3/1986 |
| JP | S63120806 | A | 5/1988 |
| JP | 104342803 | A | 11/1992 |
| JP | H05065805 | A | 3/1993 |
| JP | H06330707 | A | 11/1994 |
| JP | H07011910 | A | 1/1995 |
| JP | H08128305 | A | 5/1996 |
| JP | 2001147293 | | 5/2001 |
| JP | 2003148111 | A | 5/2003 |
| JP | 2010261389 | A | 11/2010 |
| JP | 2013050055 | A | 3/2013 |
| JP | 2013147937 | A | 8/2013 |
| JP | 2014084847 | A | 5/2014 |
| JP | 2016070223 | A | 5/2016 |

OTHER PUBLICATIONS

Corresponding Japanese Patent Application No. 2018-566572 Office Action dated Jun. 5, 2021 with English translation.

Corresponding Japanese Patent Application No. 2018566572 Notice of Allowance dated Jun. 22, 2022.

* cited by examiner

TURBINE CONTROL VALVES DYNAMIC INTERACTION

The present invention generally relates to power plant steam turbines and more particularly to a method for controlling steam admission into such a steam turbine.

Typically, a power plant steam turbine is a device which converts thermal energy of pressurized steam to mechanical energy. The thermal energy is obtained by the production of steam by a boiler. The resulting steam flow is thus supplied to the steam turbine at the required pressure and temperature.

The turbine converts the steam flow into a torque which is used for driving a rotor of an electric generator for the production of electrical energy. Particularly, the rotor of the electric generator is driven by means of a turbine shaft that interconnects the rotor with the steam turbine.

Commonly, the electric generator is coupled with an alternating current electrical grid for distributing the produced electrical energy to the consumers through a plurality of transmission lines. In order to obtain a delivery of electrical energy from the electric generator to the electrical grid, it is important that the electrical generator and the electrical grid are synchronized such that the frequency of the electrical generator matches the frequency of the electrical grid.

The steam, supplied by the boiler, enters a high pressure steam casing. The admission in the high pressure casing is done through stop valves and control valves.

After steam expansion in the high pressure casing, the steam is sent to moisture-separator reheaters pulling moisture and reheating the steam for preventing turbine from corrosion and erosion.

The dried and reheated steam is thus admitted in a reduced pressure casing, which is generally an intermediate pressure steam casing, through intermediate pressure stop and control valves, and then admitted in one or more low pressure steam casings. Certain steam turbines are not provided with intermediate pressure casing and the steam passes directly from the moisture-separator reheaters to the low pressure casings through low pressure stop and control valves.

A high volume of steam may be located in reheaters and it is important that it be contained, especially during transients such as load variation, grid fault or switch to house load turbine operating mode.

In case of such a transient, the lack of steam control may lead to an unacceptable overspeed of the turbine and/or mechanical and electrical instability which shall be avoided to protect the turbine generator unit, the turbine control valves, the electrical consumers of the power plant and the electrical consumers connected to the electrical network against stress and early aging.

In the state of the art, solutions consist in keeping the intermediate pressure admission valves, or low pressure admission valves if there is no intermediate pressure casing, fully open from turbine start-up or from a load between 5 to 40% of the nominal load. Predefined load profiles are used to reduce instability. Nevertheless, only a limited number of profiles to characterize the transient are defined. Consequently, it is not possible to respond to all type of transient.

Another solution consists in sending closing and re-opening orders to the control valves. However, the disadvantage of this solution lies on the time to recover as well as the control valves stress.

Furthermore, these solutions are not appropriate or sufficient for turbines with large dead volumes downstream intermediate pressure valves, especially between moisture-separator reheaters and intermediate pressure casing, and between intermediate pressure casing and low pressure casing.

Consequently, the present invention intends to overcome these disadvantages by providing a method for controlling admission steam into power plant steam turbine which protects the turbine generator unit, the turbine control valves, the electrical consumers of the power plant and the electrical consumers connected to the electrical network against stress and early aging.

The present invention thus proposes a method for controlling steam admission into a steam turbine, the turbine comprising a high pressure casing, at least one reduced pressure casing and an admission steam control system, the high pressure casing and at least one reduced pressure casing comprising control valves for steam admission.

The admission steam control system manages the following steps: determining a steam flow demand; elaborating a high pressure control valve opening setpoint depending on the determined steam flow demand; imposing the elaborated high pressure control valve opening setpoint to the high pressure control valves; elaborating a reduced pressure control valve opening setpoint depending on the determined steam flow demand through the dynamic interaction between high pressure control valve opening setpoint and reduced pressure control valve opening setpoint; and imposing the elaborated reduced pressure control valve opening setpoint to the reduced pressure control valves.

In an embodiment, the reduced pressure control valve opening setpoint is elaborated so that the reduced pressure control valves are more open than the high pressure control valves. In this manner, it is possible to avoid overpressure in the moisture-separator reheaters.

In an embodiment, the control system is activated during a transient of the turbine, which allows avoiding unacceptable overspeed and stress of the shaft-line due to the transient.

Preferably, the steps of imposing the elaborated high pressure control valve opening setpoint to the high pressure control valves and imposing the elaborated reduced pressure control valve opening setpoint to the reduced pressure control valves is performed through control valve position-loop cards.

In an embodiment, the steam flow demand is determined using parameters including at least the rotating speed of the turbine, the load, the live steam pressure and the turbine operating mode.

Another object of the invention relates to a steam turbine comprising a high pressure casing, at least one reduced pressure casing and a steam admission control system, the high pressure casing and at least one reduced pressure casing comprising control valves for steam admission.

Besides, the steam admission control system is configured to determine a steam flow demand, elaborate a high pressure control valves opening setpoint depending on the determined steam flow demand, impose the elaborated high pressure control valves opening setpoint to the high pressure control valves, elaborate a reduced pressure control valve opening setpoint depending on the determined steam flow demand through the dynamic interaction between high pressure control valve opening setpoint and reduced pressure control valve opening setpoint, and impose the elaborated reduced pressure control valve opening setpoint to the reduced pressure control valves.

In an embodiment, the steam admission control system comprises a high pressure control valves position-loop card and a reduced pressure control valves position-loop card.

Besides, one reduced pressure casing provided with control valves may correspond to a low pressure casing.

In another embodiment, one reduced pressure casing provided with control valves may correspond to an intermediate pressure casing.

Figure 2:
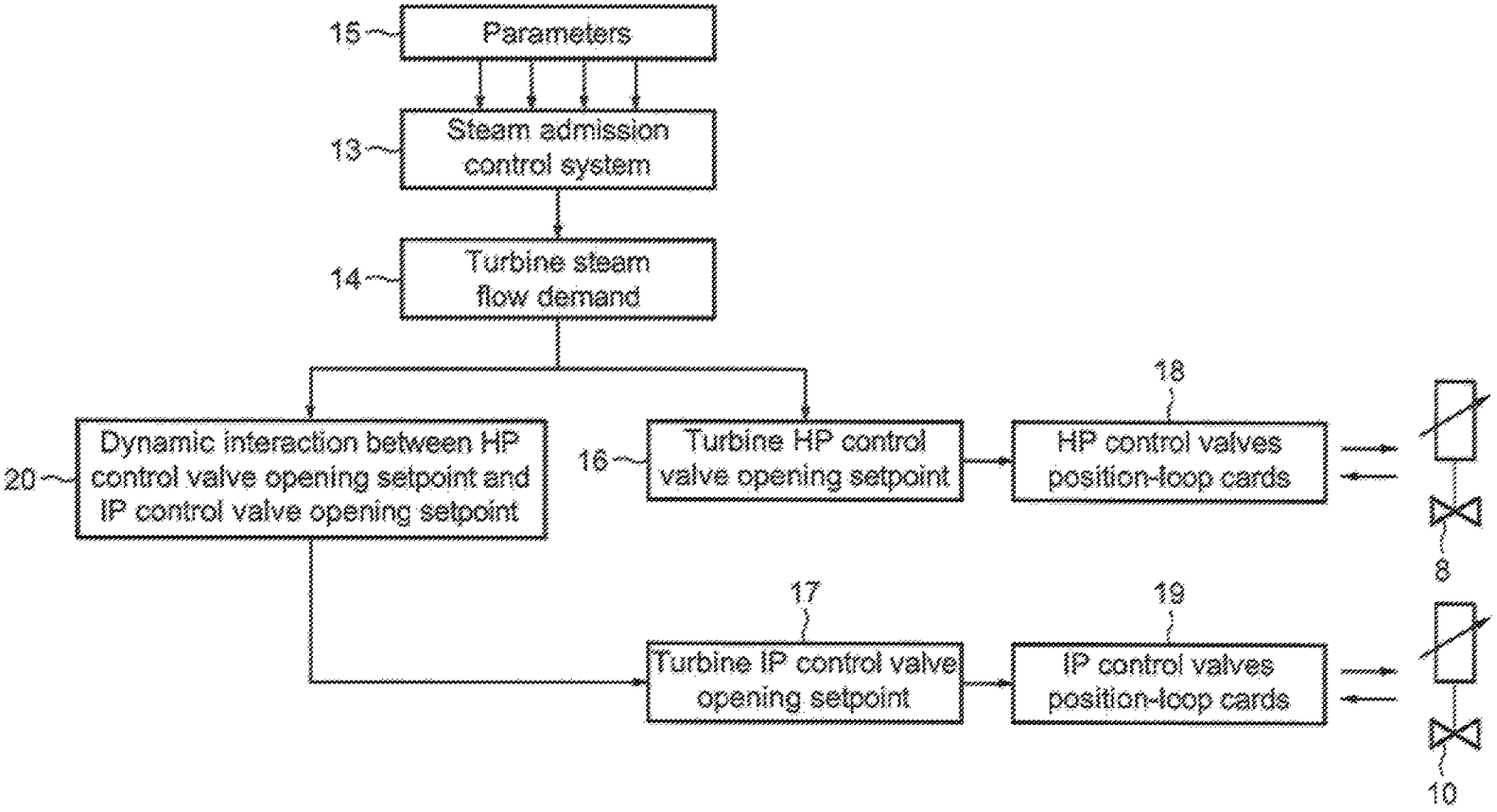

Other advantages and features of the invention will appear from the detailed description of an embodiment of the invention, which is a non limiting example, illustrated on the appended drawings of which:

FIG. 1 is a schematic view of a power plant steam turbine for use in a method according to an embodiment of the invention; and FIG. 2 illustrates the steps performed by a steam admission control system of the steam turbine of FIG. 1.

As shown on FIG. 1, a power plant steam turbine 1 comprises a high pressure steam casing 2 and at least one reduced pressure casings. In the illustrated example, the reduced pressure casings correspond to an intermediate steam casing 3 and three low pressure steam casings 4, 5 and 6. However, in another embodiment, the turbine may be provided, for example, with low pressure casings but no intermediate casing.

The steam turbine is also provided with stop valves 7 and control valves 8 upstream of the high pressure casing 2, and stop valves 9 and control valves 10 upstream of the intermediate pressure casing 3.

Two moisture-separator reheaters 11 and 12 are located upstream of the intermediate pressure stop valves 9 and control valves 10.

The steam, supplied by a boiler (not shown here), enters the high pressure steam casing 2. The admission in the high pressure casing is done through high pressure stop valves 7 and high pressure control valves 8.

After steam expansion in the high pressure casing 2, the steam is sent to moisture-separator reheaters 11 and 12.

The steam is thus admitted in the intermediate pressure casing 3, through the intermediate pressure stop valves 9 and the intermediate pressure control valves 10, and then admitted in the low pressure casings 4, 5 and 6.

Furthermore, the steam turbine 1 comprises a steam admission control system 13 which, when the turbine is running and advantageously when a transient occurs, is activated.

As illustrated in FIG. 2, in a first step, the control system 13 determines a steam flow demand 14 in function of various turbine parameters 15. The parameters 15 may include, for example, the rotating speed of the turbine, the load, the live steam pressure, the turbine operating mode, limitations and runbacks.

On one hand, the control system 13 elaborates a high pressure control valve opening setpoint 16 depending on the determined steam flow demand 14 and imposes the elaborated high pressure control opening setpoint 16 to the high pressure control valves 8.

The control system 13 converts directly the steam flow demand 14 into high pressure control valve opening setpoint 16 thanks to a predefined law.

On another hand, the control system 13 elaborates a reduced pressure control valve opening setpoint 17 and imposes the elaborated reduced pressure control valve opening setpoint 17 to the reduced pressure control valves 10. In the illustrated example, the reduced pressure control valves correspond to the control valves 10 of the intermediate pressure casing 3. Thus, the control system 13 elaborates an intermediate pressure control valve opening setpoint 17 and imposes the elaborated intermediate pressure control valve opening setpoint 17 to the intermediate pressure control valves. If, according to another embodiment, the turbine does not comprise intermediate pressure casing but only low pressure casing, that step applies to the low pressure control valves.

In the illustrated embodiment, the steam admission control system 13 comprises one position-loop card per control valve. The position-loop cards 18 for the high pressure control valves 8 and the position-loop cards 19 for the intermediate pressure control valves 10 are respectively configured to perform the steps of imposing the opening setpoint to the high pressure control valves 8 and imposing the opening setpoint to the intermediate pressure control valves 10.

The control system 13 elaborates the intermediate pressure control valve opening setpoint 17, depending on the determined steam flow demand 14, through the dynamic interaction 20 between high pressure control valve opening setpoint and the intermediate pressure control valve opening setpoint, which results in a dynamic interaction 20 between the high pressure control valves 8 position and the intermediate pressure control valves 10 position.

The dynamic of evolution of the steam flow demand is used to smoothly move from a static control of the control valves 8, 10 used in normal operation of the turbine 1 to a dynamic control used to pass over a transient.

The present invention allows a fast and stable control of the steam admission into the casings 2, 3, 4, 5, 6, and hence a fast and stable control of the turbine 1 generator unit speed and power by controlling the control valves 8, 10 position at any time.

In normal operation of the turbine 1, the method allows, for example, avoiding overpressure in the moisture-separator reheaters, imposing that the intermediate pressure control valves 10 be more open than the high pressure control valves 8 and fully open from a load between 5 and 40%.

A further advantage of the invention is, during a transient such as a load variation, a grid fault or a switch to house load operating mode, containing the high volume of steam of the moisture-separator reheaters 11, 12 and avoiding unacceptable overspeed and stress of the shaft-line that interconnects the rotor with the steam turbine 1. This is possible by controlling the high pressure control valves 8 position and the intermediate pressure control valves 10 position in parallel to adapt the thermal power regarding the electrical load, while remaining the intermediate pressure control valves 10 slightly more open than the high pressure control valves 8 in order to avoid overpressure in the moisture-separator reheaters 11, 12.

The invention claimed is:

1. A method for controlling steam admission into a steam turbine, the steam turbine comprising a high pressure casing, at least one reduced pressure casing, and at least one moisture-separator reheater to pull moisture from steam exhausted from the high pressure casing to yield dried steam and reheat the dried steam for admission to the at least one reduced pressure casing, the high pressure casing and the at least one reduced pressure casing comprising corresponding control valves for the steam admission, the corresponding control valves for the at least one reduced pressure casing positioned between the at least one moisture-separator reheater and the at least one reduced pressure casing, the method comprising:

providing the at least one reduced pressure casing opposing the high pressure casing on a turbine shaft common to both the high pressure casing and the at least one reduced pressure casing;

at an occurrence of a transient event during an operation of the steam turbine when there is a high volume of steam in the at least one moisture-separator reheater, determining a steam flow demand of the steam turbine, wherein the steam flow demand is determined using parameters that include a rotating speed of the steam turbine, a load of the steam turbine, a live steam pressure of the steam turbine, and a steam turbine operating mode;

elaborating a high pressure control valve opening setpoint as a function of the determined steam flow demand;

imposing the elaborated high pressure control valve opening setpoint to high pressure control valves associated with the high pressure casing;

elaborating a reduced pressure control valve opening setpoint as a function of the determined steam flow demand;

imposing the elaborated reduced pressure control valve opening setpoint to reduced pressure control valves associated with the at least one reduced pressure casing; and controlling the high pressure control valve opening setpoint and the reduced pressure control valve opening setpoint during the transient event, wherein the controlling includes continuing the elaborating and imposing of the high pressure control valve opening setpoint and the reduced pressure control valve opening setpoint to avoid overpressure in the at least one moisture-separator reheater during the transient event, wherein during the controlling of the high pressure control valve opening setpoint and the reduced pressure control valve opening setpoint, the reduced pressure control valves are more open than the high pressure control valves to reduce overpressure in the at least one moisture-separator reheater for protection thereof.

2. The method according to claim 1, wherein the imposing of the elaborated high pressure control valve opening setpoint to the high pressure control valves and imposing the elaborated reduced pressure control valve opening setpoint to the reduced pressure control valves are facilitated through use of control valve position-loop cards.

* * * * *